US006456721B1

(12) United States Patent
Fukuda

(10) Patent No.: US 6,456,721 B1
(45) Date of Patent: Sep. 24, 2002

(54) HEADSET WITH BONE CONDUCTION SPEAKER AND MICROPHONE

(75) Inventor: Mikio Fukuda, Tokyo (JP)

(73) Assignee: Temco Japan Co., Ltd., Tokyo (JP)

( * ) Notice: Subject to any disclaimer, the term of this patent is extended or adjusted under 35 U.S.C. 154(b) by 0 days.

(21) Appl. No.: 09/338,552

(22) Filed: Jun. 23, 1999

(51) Int. Cl.[7] ..... H04R 25/00
(52) U.S. Cl. ..... 381/380; 381/378; 381/151
(58) Field of Search ..... 381/151, 326, 381/370, 375, 380, FOR 130; 600/25; 607/56

(56) References Cited

U.S. PATENT DOCUMENTS 2,255,250 A * 9/1941 Greibach ..... 381/151
2,459,325 A * 1/1949 Knowles ..... 381/151
3,869,584 A * 3/1975 Wilde ..... 381/151
4,025,734 A * 5/1977 Aloupis ..... 381/151
4,591,668 A * 5/1986 Iwata ..... 381/151
4,654,883 A * 3/1987 Iwata ..... 381/151
4,821,323 A * 4/1989 Papiernik ..... 381/151
5,125,032 A * 6/1992 Meister et al. ..... 381/151
5,323,468 A * 6/1994 Bottesch ..... 381/151
5,511,132 A * 4/1996 Yoshimi ..... 381/151
5,590,213 A * 12/1996 Urella et al. ..... 381/370
5,608,808 A * 3/1997 Da Silva ..... 381/370
5,721,775 A * 2/1998 Leifer ..... 381/370
5,784,478 A * 7/1998 Untersander ..... 381/326
5,984,145 A * 11/1999 McAllister ..... 381/370

* cited by examiner

*Primary Examiner*—Curtis Kuntz
*Assistant Examiner*—Suhan Ni
(74) *Attorney, Agent, or Firm*—Browdy and Neimark

(57) ABSTRACT

A headset with both a bone conduction speaker (1) and a microphone (2) is: excellent in fittingness to a wearer's head; free from any feeling of physical disorder; comfortable in use for a long period of time; and, substantially free from howling produced between the bone conduction speaker (1) and the microphone (2), and has its headband (3) run round the back part and the top part of the head. The headband (3) has its opposite ends carry a pair of head pads (5) held in abutting contact with opposite sides of the head. At least one of the head pads (5) carries both the bone conduction speaker (1) and the microphone (2).

8 Claims, 3 Drawing Sheets

HEADSET WITH BONE CONDUCTION SPEAKER AND MICROPHONE

BACKGROUND OF THE INVENTION

1. Field of the Invention

The present invention relates to a headset, and more particularly to a headset provided with both a bone conduction speaker and a microphone to provide a two-way speech means and is capable of being worn on a wearer's head through a headband in use.

2. Description of the Related Art

Heretofore, it has been known to provide, as one of such two-way speech means, a conventional headset provided with both a bone conduction speaker and a microphone such as one shown in FIGS. 6(A) and 6(B). In this conventional headset, a headband 13 running round a top part of the wearer's head has at least one of its opposite end portions carry a bone conduction speaker 11 to which a microphone 12 is attached. In this conventional type of the headset, since the headband 13 thereof is poor in fittingness to the wearer's head, an auxiliary band 14 running round both a top part of the wearer's head and a lower jaw part of the wearer as shown in FIG. 6(B) is often used in combination with the headband 13.

Since the bone conduction speaker of the headset is means for transmitting the wearer's speech (i.e., ordinary sounds) as bone conduction sounds, it is necessary to hold the bone conduction speaker in abutting contact with a local area around the ear of the wearer. Due to this, such local area around the ear of the wearer is always brought into press contact the bone conduction speaker, which makes the wearer of the conventional headset uncomfortable in feeling when the headset is worn by the wearer for a relatively long period of time. Further, in the conventional headset, since the microphone is mounted on the bone conduction speaker, the microphone is prone to pick up vibrations of the bone conduction speaker, and, therefore often suffers from howling problems.

As described above, the conventional headset is poor in fittingness to the wearer's head, and often suffers from the howling problems occurring between the bone conduction speaker and the microphone.

SUMMARY OF THE INVENTION

Consequently, it is an object of the present invention to provide a headset which is free from the above problems inherent in the conventional headset. More specifically, it is an object of the present invention to provide a headset provided with both a bone conduction speaker and a microphone, wherein: the headset is excellent in fittingness to the wearer's head, free from any feeling of physical disorder, comfortable in use even for a relatively long period of time, and free from any howling problems.

The above object of the present invention is accomplished by providing:

A headset comprising:

- a headband capable of running round both a back part and a top part of a wearer's head, the headband being provided with opposite end portions;
- a pair of head pads carried by said opposite end portions of said headband and held in abutting contact with opposite side parts of said wearer's head; and
- a bone conduction speaker and a microphone both of which are carried by at least one of said head pads.

In the headset of the present invention having the above construction, preferably, each of the head pads is covered with a cushioning member.

Further, in the headset of the present invention, preferably, the bone conduction speaker is mounted on a front end portion of a speaker mounting arm which extends from the head pad.

Still further, in the headset of the present invention, preferably: the bone conduction speaker is mounted on a front end portion of a speaker mounting arm which extends from the head pad; and, the speaker mounting arm is rotatably mounted on the head pad.

Further, in the headset of the present invention, preferably, the bone conduction speaker is held in abutting contact with an area in front of an auricle (i.e., ear) of the wearer when the headset is worn by the wearer.

Still further, in the headset of the present invention, preferably, the bone conduction speaker is held in abutting contact with an area behind the ear of the wearer when the headset is worn by the wearer.

Further, in the headset of the present invention, preferably, the microphone is mounted on the head pad through a shock mount made of a cushioning/damping material.

Still further, in the headset of the present invention, preferably, the microphone is constructed of a bone conduction microphone.

DESCRIPTION OF THE PREFERRED EMBODIMENTS

Hereinbelow, the present invention will be described in detail using its preferred embodiments with reference to the accompanying drawings.

Figure 1:
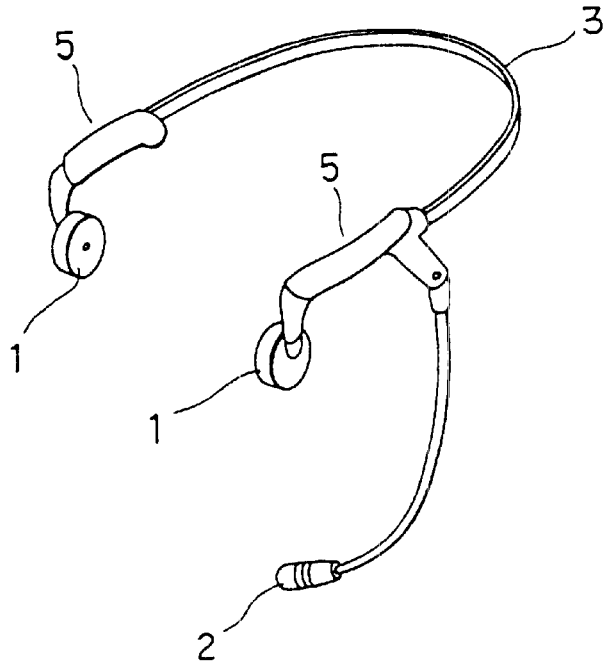
FIG. 1 is a perspective view of a first embodiment of the headset of the present invention provided with both a bone conduction speaker and a microphone.
Figure 2:
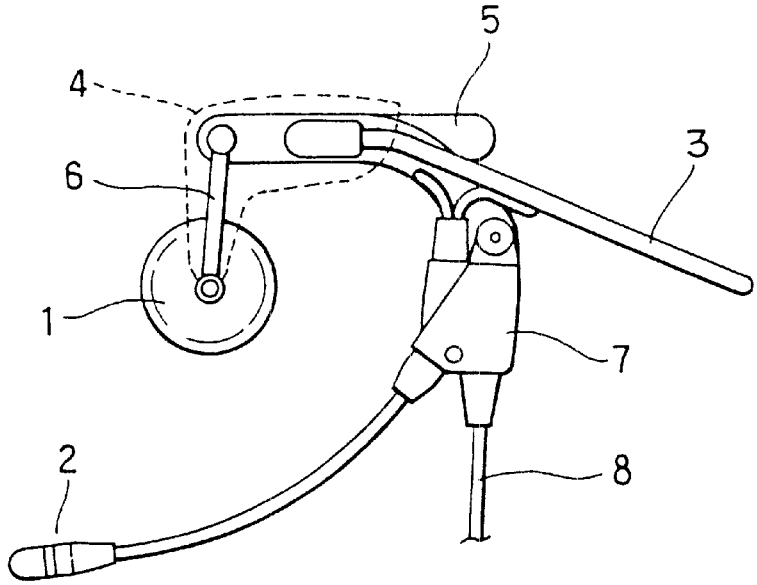
FIG. 2 is a side view of the first embodiment of the headset of the present invention shown in FIG. 1.

As shown in FIG. 1, a first embodiment of a headset of the present invention is provided with: a pair of bone conduction speakers 1; a microphone 2; and, a headband 3. The headband 3 is made of a resilient material, and has its opposite end portions carry a pair of head pads 5 each of which is covered by a cushioning member 4 (shown in FIG. 2 in dotted lines and in FIG. 3 in solid lines) made of a suitable material such as urethane foam and the like. On the other hand, as shown in FIG. 2, each of a pair of speaker mounting arms 6 is mounted on a front end portion of the head pad 5, preferably rotatably mounted thereon. The bone conduction speaker 1 is mounted on a free end portion of the speaker mounting arm 6, as shown in FIG. 2. The cushioning member 4 covers also the speaker mounting arm 6. Incidentally, it is also possible to mount the bone conduction speaker 1 in only one of the head pads 5 of the headset of the present invention.

As is clear from FIG. 2, mounted on a rear portion of the head pad 5 is a shock mount 7 which is preferably made of a cushioning/damping material. Through this shock mount 7, the microphone 2 is mounted on the rear portion of the head pad 5. As for the microphone 2 used in this first embodiment of the present invention, it may be either an ordinary microphone for speech use or a so-called bone conduction microphone for picking up the bone conduction sounds. When the microphone 2 is of the former type, i.e., ordinary microphone type, the microphone 2 is disposed in the vicinity of a wearer's mouth. On the other hand, when the microphone 2 is of the latter type, i.e., bone conduction type, the microphone 2 is held in abutting contact with a desired area in a side part of the wearer's head.

A cord 8 extending from both the bone conduction speaker 1 and the microphone 2 is connected with a suitable radio equipment (not shown) received in the wearer's pocket and the like.

Figure 3:
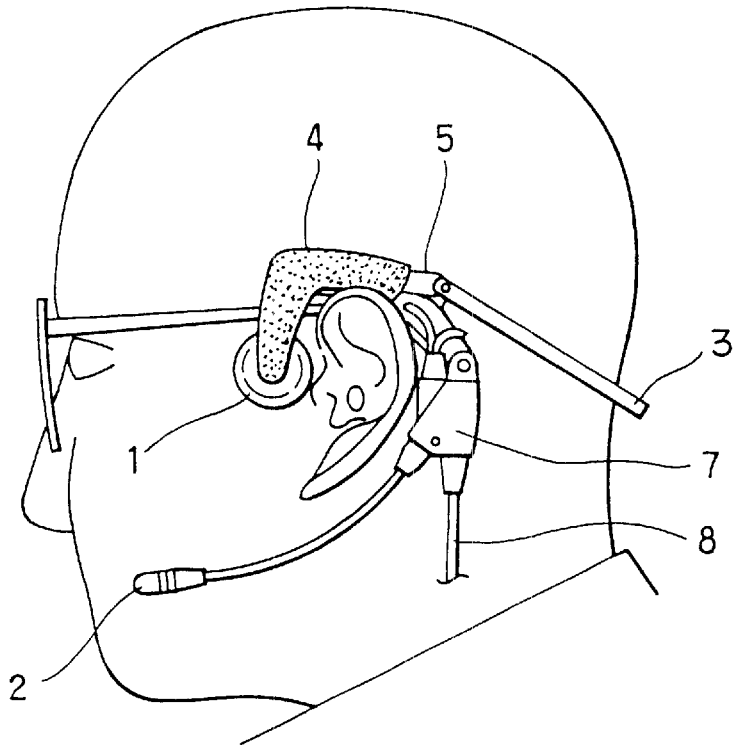
FIG. 3 is a side view of the first embodiment of the headset of the present invention shown in FIG. 1.

FIG. 3 shows the headset of this first embodiment worn on the wearer's head in use, wherein: the head pad 5 is hung up on the ear of the wearer; and, the headband 3 runs round a back part of the wearer's head. On the other hand, each of the bone conduction speakers 1 is held in resilient abutting contact with an area in front of the ear in the side part of the Wearer's head due to the effects of resiliency of the headband 3. In this first embodiment of the present invention, a holding force required to hold the bone conduction speakers 1 of the headset in resilient abutting contact with the side parts of the Wearer's head is essentially applied to each of the head pads 5, and, therefore not concentrated on a one point but dispersed over the entire contact area of each of the head pads 5. Consequently, there is no fear that the wearer of the headset of the present invention suffers from a pain or a feeling of physical disorder in the sides of his head, which makes it possible for the headset of the present invention to be worn by the wearer in a comfortable and steady manner.

It is also possible for the wearer of the headset of the present invention to wear additional head gear such as helmets, caps and the like on the headset of the present invention.

In this first embodiment of the headset of the present invention, since it is possible to have the bone conduction speaker 1 spaced apart from the microphone 2 through the head pad 5, any howling problems are also prevented from occurring. Mounting the microphone 2 through the shock mount 7 is effective to prevent the howling problems from occurring.

Figure 6:
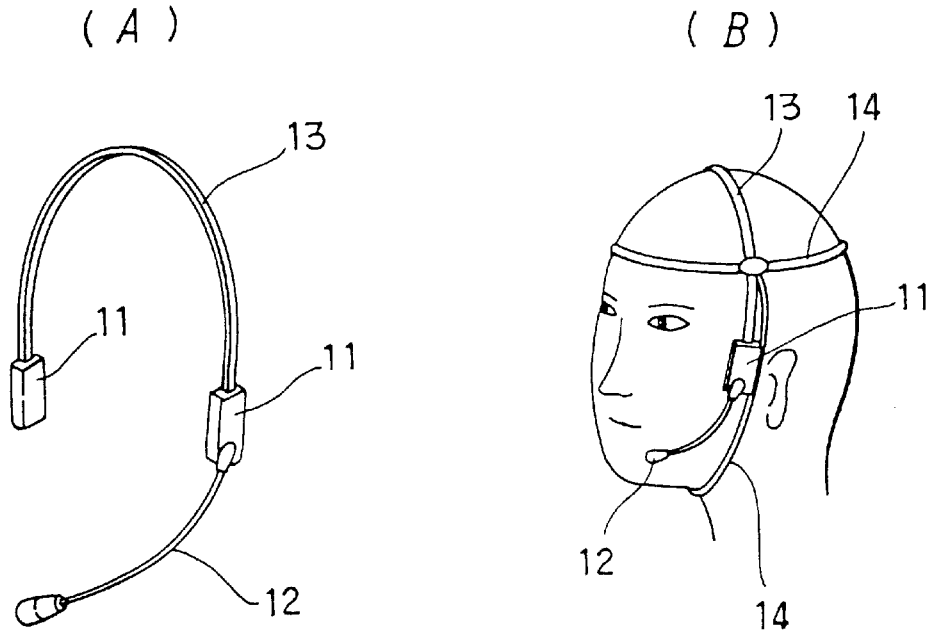
FIG. 6(A) is a perspective view of the conventional headset.
FIG. 6(B) is a perspective view of the conventional headset shown in FIG. 6(A) in use, illustrating the auxiliary band combined with the headband.

The headset of the present invention can be used in a manner described above. Further, it is also possible to use the headset of the present invention in a manner such that the headband 3 runs round a top part of the wearer's head, as is in the same manner as that shown in FIGS. 6(A) and 6(B). More specifically, in order to have the headband 3 run round the top part of the wearer's head, it is necessary to mount the opposite end portions of the headband 3 on the head pads 5 so as to be rotatable relative to the head pad 5, which makes it possible for the headband 3 to run round both the back part and the top part of the wearer's head, i.e., to serve as a double-purpose top and side headband.

Alternatively, it is also possible for the headband 3 to be mounted on the head pads 5 so as to extend in a direction perpendicular to a lateral portion of the head pad 5, which makes it possible for the headband 3 to run round only the top part of the wearer's head, i.e., to serve as an exclusive top headband.

Figure 4:
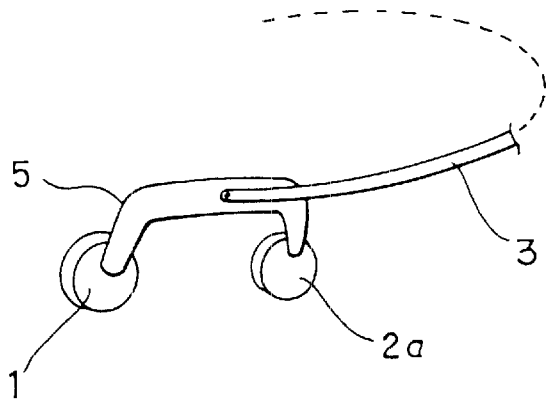
FIG. 4 is a perspective view of a second embodiment of the headset of the present invention provided with both the bone conduction speaker and the microphone.

FIG. 4 shows a second embodiment of the headset of the present invention, in which the microphone 2 of the first embodiment of the present invention is replaced with a bone conduction microphone 2*a*. In this second embodiment of the headset of the present invention, the head pad 5 assumes a suitable shape capable of sitting astride the ear of the wearer.

The bone conduction speaker 1 of this second embodiment of the present invention is mounted on a front end portion of the head pad 5 as viewed in FIG. 4, and held in abutting contact with an area in front of the ear in the side part of the wearer's head, as is in the first embodiment of the present invention shown in FIG. 1. On the other hand, the bone conduction microphone 2*a* of the second embodiment is mounted on a rear portion of the head pad 5, and held in abutting contact with a rear area of the ear in the side part of the wearer's head.

In FIG. 4, it is also possible for this second embodiment of the headset of the present invention to replace in position its bone conduction speaker 1 with its bone conduction microphone 2*a* or vice versa. In this second embodiment of the present invention, the head pad 4 is also covered with the cushioning member 4 (shown in FIG. 3).

Figure 5:
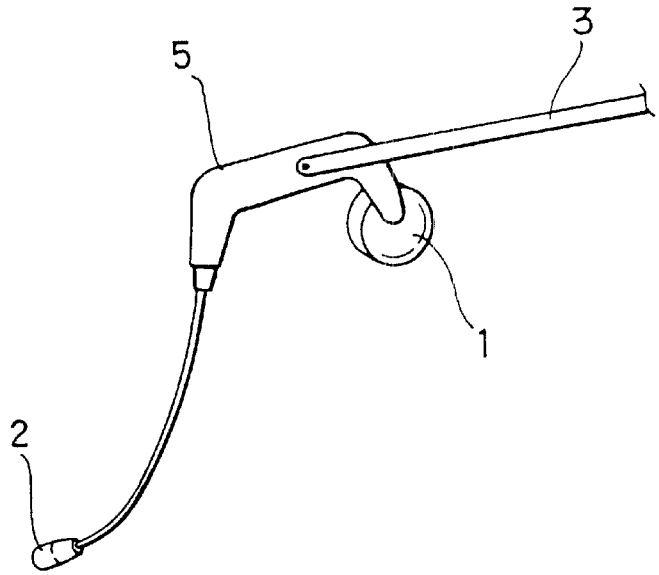
FIG. 5 is a perspective view of a third embodiment of the headset of the present invention provided with both the bone conduction speaker and the microphone.

FIG. 5 shows a third embodiment of the headset of the present invention. In this third embodiment of the present invention, the bone conduction speaker 1 of the first embodiment of the present invention shown in FIG. 1 is replaced in mounting position with the microphone 2 of the first embodiment of the present invention to form the third embodiment of the present invention. In this third embodiment of the present invention, the bone conduction speaker 1 is held in abutting contact with a rear area of the ear in the side part of the wearer's head.

Consequently, in use, the headset of the present invention having the above construction has the following effects: namely, since the headset of the present invention has its head pad 5: covered with the cushioning member 4; hung up on the ear of the wearer; and, held in abutting contact with the side part of the wearer's head, the headset of the present invention is excellent in fittingness of its headband 3 to the wearer's head.

Further, the headset of the present invention having the above construction is capable of being worn on the wearer's head in a comfortable and steady manner for a relatively long period of time, because the resilient force exerted by the headband 3 and applied to the opposite side parts of the wearer's head due to the presence of resiliency of the headband 3 is dispersed over the entire area of each of the head pads 5.

What is claimed is:

1. A headset adapted for use on a head of a user so as to position a speaker and microphone spaced apart from an ear of the user, comprising:

an elastic headband capable of running round both a back part or a top part of the head of the user, said headband being provided with opposite end portions;

a pair of head pads carried by said opposite end portions of said headband having a linear portion with a side wall adapted to be held in abutting contact with opposite side parts of the head of the user by the headband;

a bone conduction speaker and a microphone both of which are carried by at least one of said head pads spaced apart laterally from the ear of the user;

wherein said speaker directly engages the head of the user;

wherein said bone conduction speaker is mounted on a front end portion of a speaker mounting arm extending from said head pad;

wherein said speaker mounting arm is rotatably mounted on said head pad in a plane through the speaker mounting arm the head pad and the bone conduction speaker.

2. The headset as set forth in claim 1, wherein each of said head pads is covered with a cushioning member.

3. The headset as set forth in claim 1, wherein said bone conduction speaker is mounted on a front end portion of a speaker mounting arm extending from said head pad.

4. The headset as set forth in claim 3, wherein said speaker mounting arm is rotatably mounted on said head pad.

5. The headset as set forth in claim 1, wherein said bone conduction speaker is held in abutting contact with an area in front of the ear of said user when said headset is worn by said user.

6. The headset as set forth in claim 1, wherein said bone conduction speaker is held in abutting contact with an area behind the ear of said user when said headset is worn by said user.

7. The headset as set forth in claim 1, wherein said microphone is mounted on said head pad through a shock mount made of a cushioning/damping material.

8. The headset as set forth in claim 1, wherein said microphone is constructed of a bone conduction microphone.

* * * * *